United States Patent [19]

Hebert

[11] 4,077,628

[45] Mar. 7, 1978

[54] RACE TRACK GAME

[76] Inventor: Frederick G. Hebert, 14 Oak Terrace, Caselton, N.Y. 12033

[21] Appl. No.: 748,239

[22] Filed: Dec. 6, 1976

[51] Int. Cl.[2] ..... A63F 9/14

[52] U.S. Cl. ..... 273/86 C

[58] Field of Search ..... 273/86 C, 86 E, 118 R, 273/120 R; 46/43

[56] References Cited

U.S. PATENT DOCUMENTS

| | | | |
|---|---|---|---|
| 1,278,203 | 9/1918 | Pierce | 273/118 R UX |
| 2,726,869 | 12/1955 | Schulte | 273/86 C |
| 2,853,301 | 9/1958 | Glass | 273/86 C |
| 3,502,332 | 3/1970 | Wolf | 273/86 C |

FOREIGN PATENT DOCUMENTS

| | | | |
|---|---|---|---|
| 922,250 | 3/1963 | United Kingdom | 273/86 E |

*Primary Examiner*—Anton O. Oechsle

[57] ABSTRACT

Discloses a race track game for toy racing vehicles having a planar and downwardly-sloped raceway having upstanding side walls comprising a first multiple-lane starting section having upstanding ribs defining equally spaced-apart lanes for the vehicles, a second funnel-shaped section converging from the first multiple-lane starting section to a third multiple-lane section having an upstanding rib defining equally spaced-apart lanes for the vehicles and a fourth funnel-shaped section converging from the third multiple-lane section to a fifth victory section.

9 Claims, 5 Drawing Figures

RACE TRACK GAME

This invention relates to a race track game which is structurally unique and unique in function, inclusive of which is the object of this invention and its contribution to the art, in that the excitement and continued interest which this race track game generates and sustains arises from the fact that the participants do not know from the start of the race whether any one of the vehicles will actually finish the race.

Accordingly, this object and other objects of the invention contributing to the art should be discerned and appreciated by reference to the detailed specification taken in conjunction with the drawings, wherein like reference numerals refer to similar parts throughout the several views, in which.

Figures 1, 2, 3, 4, 5:
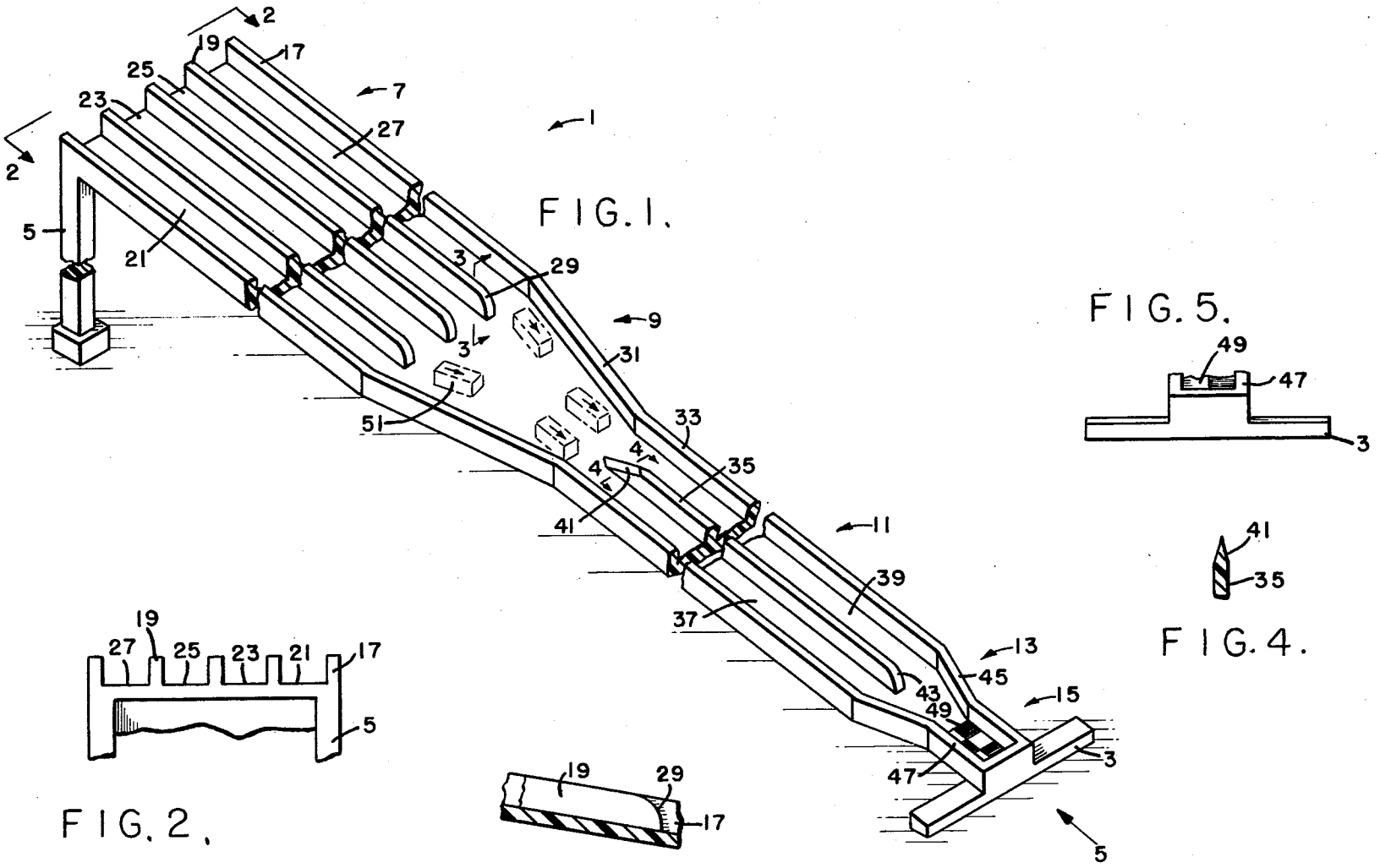
FIG. 1 is a perspective view of the invention.
FIG. 2 is a view taken in the direction of the arrows 2 — 2 in FIG. 1.
FIG. 3 is a sectional view taken in the direction of the arrows 3 — 3 in FIG. 1.
FIG. 4 is a sectional view taken in the direction of the arrows 4 — 4 in FIG. 1.
FIG. 5 is a view in the direction of the arrow 5 in FIG. 1.

In FIG. 1 of the drawings, reference numeral 1 generally refers to the invention which has a planar raceway, footed at its terminal end by means of a transverse support 3 and downwardly sloped by means of vertical support 5 at its other remote end.

The raceway has five sections. A first starting section consisting of four vehicle lanes, generally referred to by reference numeral 7 in FIG. 1, converges by means of a second funnel-shaped section, generally referred to by reference numeral 9 in FIG. 1, to a third two-lane section, generally referred to by reference numeral 11 in FIG. 1, converges by means of a fourth funnel-shaped section, generally referred to by reference numeral 13 in FIG. 1, to a fifth victory section, generally referred to by reference numeral 15 in FIG. 1.

First starting section 7 has upstanding side walls 17 and three equally spaced upstanding ribs 19, thereby forming four equally spaced-apart vehicle lanes 21, 23, 25 and 27 and guide the vehicles therein. The terminal portions of ribs 19 are arcuately formed, as shown more discernably in FIG. 3 and as indicated by reference numeral 29.

The second funnel-shaped section 9 has upstanding side walls 31 which converge, as shown, from the four-lane starting section 7 to the third two-lane section 11.

The third two-lane section 11 has upstanding side walls 33 and an upstanding rib 35 equally spaced from side walls 33 to thereby form two equally spaced-apart vehicle lanes 37 and 39 and guide the vehicles therein. One end of rib 35 is tapered, as shown more discernably in FIG. 4 and as indicated by reference numeral 41, and the other end of rib 35 is arcuately formed as indicated by reference numeral 43. The tapered end 41 of rib 35 functions as a ramp such that if a vehicle hits same, such vehicle will flip over and possibly leave the raceway itself.

The fourth funnel-shaped section 13 has upstanding side walls 45 which converge, as shown, from the two-lane section to the fifth victory section 15.

The fifth victory section 15 has upstanding side and bottom walls 47 and a checkered victory lane 49.

Shown in FIG. 1 on the second funnel-shaped section 9 of the raceway are four simulated toy racing vehicles 51.

The game can be played by using from two to four of the racing vehicles 51. The object of the game is for one of the vehicles 51 to win the race by entering the checkered victory lane 49 first. This may or may not happen.

Each player disposes his respective vehicle in position at the top of one of the preselected lanes 21, 23, 25 or 27 for release upon signal. When released the vehicles will travel downwardly and accelerate in lanes 21, 23, 25 and 27, respectively. When such vehicles enter the funnel-shaped section 9, the vehicles in the outer lanes 21 and 27 will be constrained and directed by side walls 31 toward the center of the funnel-shaped section 9. In such funnel-shaped section 9, the vehicles 51 will either collide with one another or continue on their way. Moreover, should a vehicle hit the tapered end 41 of rib 35, such vehicle will either flip over or, in so flipping over, leave the raceway itself thereat defined by the side walls 31 of funnel-shaped section 9. Vehicles remaining in the race will enter one or the other of vehicle lanes 37 and 39 and continue down same to the funnel-shaped section 13 whose side walls 45 will constrain and direct such vehicles toward the center and thereby toward the checkered victory lane 49 of victory section 15. Of course, any of the vehicles traveling at the same or approximate time down vehicle lanes 37 and 39 of the two-lane section 11 have a good chance of collision when they enter funnel-shaped section 13. The excitement and continued interest, which this race track game generates and sustains, arises from the fact that no one knows whether his or any other vehicle will finish the race.

Having thusly described my invention, I claim:

1. A race track game for toy racing vehicles having a downwardly-sloped raceway comprising a first multiple-lane starting section for said vehicles, a second, open-area, funnel-shaped section, a third multiple-lane section having fewer lanes than said first multiple-lane section, a fourth, open-area, funnel-shaped section and a fifth victory section, said second funnel-shaped section converging said raceway from said first multiple-lane section to said third multiple-lane section and said fourth funnel-shaped section converging said raceway from said third multiple-lane section to said fifth victory section.

2. A race track game in accordance with claim 1, wherein are further provided transverse and vertical supports footing said raceway, and supporting and disposing said raceway in downward-sloped relationship, respectively.

3. A race track game in accordance with claim 1, wherein said first multiple-lane section has upstanding side walls and equally-spaced upstanding ribs forming thereby equally spaced-apart vehicle lanes.

4. A race track game in accordance with claim 1, wherein said third multiple-lane section has upstanding side walls and an upstanding rib equally spaced from said side walls forming thereby equally spaced-apart vehicle lanes.

5. A race track game in accordance with claim 1, wherein said third multiple-lane section has upstanding side walls and an upstanding rib equally spaced from said side walls forming thereby equally spaced-apart vehicle lanes and wherein one end of said upstanding rib is tapered forming thereby a ramp to flip over a vehicle hitting same.

6. A race track game in accordance with claim 1, wherein said raceway is planar.

7. A race track game in accordance with claim 1, wherein said first multiple-lane section has upstanding side walls and equally-spaced upstanding ribs forming thereby equally spaced-apart vehicle lanes; and wherein said third multiple-lane section has upstanding side walls and an upstanding rib equally spaced from said side walls forming thereby equally spaced-apart vehicle lanes.

8. A race track game in accordance with claim 1, wherein said raceway is planar; wherein are further provided transverse and vertical supports footing said raceway, and supporting and disposing said raceway in downward-sloped relationship, respectively.

9. A race track game in accordance with claim 1, wherein said raceway is planar; wherein said first multiple-lane starting section has upstanding side walls and equally-spaced upstanding ribs forming thereby equally spaced-apart vehicle lanes; wherein said third multiple-lane section has upstanding side walls and an upstanding rib equally spaced from said side walls forming thereby equally spaced-apart vehicle lanes and wherein one end of said upstanding rib is tapered forming thereby a ramp to flip over a vehicle hitting same; wherein said second funnel-shaped section, said fourth funnel-shaped section and said fifth victory section have upstanding side walls; and wherein are further provided transverse and vertical supports footing said raceway, and supporting and disposing said raceway in downward-sloped relationship, respectively.

* * * * *